US005697462A

United States Patent [19]

Grimes et al.

[11] Patent Number: 5,697,462

[45] Date of Patent: Dec. 16, 1997

[54] EARTH-BORING BIT HAVING IMPROVED CUTTING STRUCTURE

[75] Inventors: Robert E. Grimes; Rudolf Carl Otto Pessier; Christopher J. Rohmer, all of Houston, Tex.

[73] Assignee: Baker Hughes Inc., Houston, Tex.

[21] Appl. No.: 693,556

[22] Filed: Aug. 7, 1996

Related U.S. Application Data

[63] Continuation of Ser. No. 497,618, Jun. 30, 1995, abandoned.

[51] Int. Cl.[6] ..... E21B 10/16; E21B 10/52; E21B 10/58

[52] U.S. Cl. ..... 175/374; 175/426

[58] Field of Search ..... 175/331, 356, 175/374, 378, 420.1, 426, 431

[56] References Cited

U.S. PATENT DOCUMENTS

| | | | |
|---|---|---|---|
| 1,896,251 | 2/1933 | Scott | 175/378 |
| 2,086,486 | 7/1937 | Woods | 175/333 |
| 2,177,332 | 11/1939 | Reed | 175/376 |
| 2,333,746 | 11/1943 | Scott et al. | 175/376 |
| 2,363,202 | 11/1944 | Scott | 175/378 |
| 2,527,838 | 10/1950 | Morlan et al. | 175/376 |
| 2,533,257 | 12/1950 | Woods et al. | 175/341 |
| 2,533,258 | 12/1950 | Morlan et al. | 175/378 |
| 2,533,259 | 12/1950 | Woods et al. | 175/341 |
| 2,533,260 | 12/1950 | Woods et al. | 175/341 |
| 2,687,875 | 8/1954 | Morlan et al. | 175/374 |
| 2,759,706 | 8/1956 | Peter | 175/378 |
| 2,774,570 | 12/1956 | Cunningham | 175/374 |
| 2,774,571 | 12/1956 | Morlan | 175/341 |
| 2,804,282 | 8/1957 | Spengler, Jr. | 175/378 |
| 2,887,302 | 5/1959 | Garner | 175/374 |
| 2,907,551 | 10/1959 | Peter | 175/375 |
| 2,939,684 | 6/1960 | Payne | 175/375 |
| 2,965,184 | 12/1960 | Morlan | 175/356 |
| 3,104,726 | 9/1963 | Davis | 175/331 |
| 3,397,751 | 8/1968 | Reichmuth | 175/341 |
| 3,412,817 | 11/1968 | Reichmuth | 175/341 |
| 3,442,342 | 5/1969 | McElya et al. | 175/374 |
| 3,946,820 | 3/1976 | Knapp | 175/341 |
| 4,140,189 | 2/1979 | Garner | 175/431 |
| 4,148,368 | 4/1979 | Evans | 175/428 |
| 4,343,371 | 8/1982 | Baker, III et al. | 175/329 |
| 4,393,948 | 7/1983 | Fernandez | 175/378 X |
| 4,832,139 | 5/1989 | Minikus et al. | 175/426 |
| 4,869,329 | 9/1989 | Kar et al. | 175/426 X |
| 4,940,099 | 7/1990 | Deane et al. | 175/426 X |
| 5,145,016 | 9/1992 | Estes | 175/331 |
| 5,197,555 | 3/1993 | Estes | 175/431 |
| 5,201,376 | 4/1993 | Williams | 175/374 |
| 5,224,560 | 7/1993 | Fernandez | 175/431 X |
| 5,311,958 | 5/1994 | Isbell et al. | 175/341 |
| 5,323,865 | 6/1994 | Isbell et al. | 175/378 |

OTHER PUBLICATIONS

Smith Int'l., Inc.—Product Brochure, U.S.A. (circa 1991).
Rock Bit Int'l., Inc.—Product Brochure U.S.A. (circa 1992).
Dresser–Security—Product Brochure, U.S.A. (1992).

*Primary Examiner*—David J. Bagnell
*Attorney, Agent, or Firm*—Robert A. Felsman; Mark D. Perdue

[57] ABSTRACT

A bit body has at least one cantilevered bearing shaft depending inwardly and downwardly from the bit body. A cutter is mounted for rotation on the bearing shaft and includes a plurality of cutting elements arranged in generally circumferential rows on the cutter, the rows including a heel row. The cutting elements in the heel row include at least one chisel-shaped cutting element having a crest oriented transversely to the axis of rotation of the cutter. The remainder of the cutting elements in the heel row have a configuration different from the chisel-shaped elements. All of the cutting elements have approximately the same projection from the surface of the cutter.

23 Claims, 2 Drawing Sheets

EARTH-BORING BIT HAVING IMPROVED CUTTING STRUCTURE

This is a continuation of application Ser. No. 08/497,618, filed Jun. 30, 1995, now abandoned.

BACKGROUND OF THE INVENTION

1. Field of the Invention

This invention relates generally to earth-boring drill bits, and particularly to improved cutting structures for such bits.

2. Background Information

The success of rotary drilling enabled the discovery of deep oil and gas reservoirs. The rotary rock bit was an important invention that made rotary drilling economical.

Only soft earthen formations could be commercially penetrated with the earlier drag bit, but the two-cone rock bit, invented by Howard R. Hughes, U.S. Pat. No. 930,759, drilled the hard caprock at the Spindletop Field near Beaumont, Tex., with relative ease. That venerable invention, within the first decade of this century, could drill a scant fraction of the depth and speed of the modern rotary rock bit. If the original Hughes bit drilled for hours, the modern bit drills for days. Modern bits sometimes drill for thousands of feet instead of merely a few feet. Many advances have contributed to the impressive improvement of rotary rock bits.

In drilling boreholes in earthen formations by the rotary method, rock bits fitted with one, two, or three rolling cutters are employed. The bit is secured to the lower end of a drillstring that is rotated from the surface or by downhole motors or turbines. The cutters mounted on the bit roll and slide upon the bottom of the borehole as the drillstring is rotated, thereby engaging and disintegrating the formation material to be removed. The roller cutters are provided with teeth that are forced to penetrate and gouge the bottom of the borehole by weight from the drillstring. The cuttings from the bottom and sidewalls of the borehole are washed away by drilling fluid that is pumped down from the surface through the hollow, rotating drillstring and are carried in suspension in the drilling fluid to the surface.

The form and location of the cutting elements upon the cutters have been found to be extremely important to the successful operation of the bit. Certain aspects of the design of the cutters become particularly important if the bit is to penetrate deeply into a formation to effectively strain and induce failure in more plastically behaving rock formations such as shales, siltstones, and chalks.

Conventional cutting structures employ heavily populated heel rows of cutting elements that serve to disintegrate the bottom of the borehole at its outer periphery and to scrape the sidewall and corner of the borehole. This cutting action in the corner and sidewall of the borehole generates fine cuttings that tend to cause bit "balling." Balling occurs when formation material becomes lodged between the cutting elements on the cutters of the bit. Balling prevents the inserts of the cutter from penetrating to full depth, thus resulting in inefficient and costly drilling. Balling also prevents the force on the tips or crests of the cutting elements from reaching a level sufficient to fracture rock.

Another problem frequently encountered in drilling is known as "tracking," and occurs when the cutting elements of a cutter fall in the same indentations made on the previous revolution of the bit. Tracking causes the formation of a pattern of smooth hills and valleys, known as "rock teeth" or "rock ribs," on the bottom of the borehole. Tracking thus results in a sculptured drilling surface that closely matches the pattern of the cutting elements, making it more difficult for the cutting elements to reach virgin rock at the bottom of the valleys. The sculptured pattern also tends to redistribute the weight on the bit from the tips or crests of the cutting element to the cutter shell surface, which impedes deep penetration, leads to inefficient material fragmentation, and often leads to damage to the bit and bit bearings.

Commonly assigned U.S. Pat. No. 5,323,865, Jun. 28, 1994 to Isbell et al.; and U.S. Pat. No. 5,311,958, May 17, 1994 to Isbell et al., disclose cutting structure designed to reduce the problems of balling and tracking. These patents disclose cutters having heel rows of cutting elements having "circumferential" crests in combination with heel rows on another cutter having "axial" crests. The circumferentially oriented crests are oriented transversely to the axis of rotation of the cutter, while the axially oriented crests are aligned with the axis of rotation of the cutter. The row of circumferential cutting elements on one cutter cooperates with the row of axial inserts on another cutter to provide a cutting structure that possesses increased ability to avoid tracking and balling conditions and results in more efficient and rapid penetration of formation material. The circumferential cutting elements combine with the more conventional axial cutting elements to "dice" nascent rock teeth or ribs between impressions left by the axial cutting elements.

Commonly assigned U.S. Pat. No. 5,351,768, Oct. 4, 1994 to Scott et al. discloses an earth-boring bit employing a secondary cutting structure comprised of chisel-shaped trimmer or scraper inserts secured to the intersection of the gage and heel surfaces of each cutter intermediate the conventional primary heel cutting structure, in the form of axial heel inserts. The heel or scraper inserts are designed to kerf or scrape the sidewall of the borehole and reduce the burden on the heel elements of maintaining a full gage borehole. The trimmer or scraper elements are not intended to function as primary cutting structure.

A need exists, therefore, for earth-boring bits having improved cutting structures that avoid tracking and balling conditions.

SUMMARY OF THE INVENTION

It is a principal object of the present invention to provide an earth-boring bit having an improved cutting structure.

This and other objects of the present invention are achieved by providing a bit body having at least one cantilevered bearing shaft depending inwardly and downwardly from the bit body. A cutter is mounted for rotation on the bearing shaft and includes a plurality of cutting elements arranged in generally circumferential rows on the cutter, the rows including a heel row. The cutting elements in the heel row include at least one chisel-shaped cutting element having a crest oriented transversely to the axis of rotation of the cutter. The remainder of the cutting elements in the heel row have a configuration different from the chisel-shaped elements. All of the cutting elements have approximately the same projection from the surface of the cutter.

According to the preferred embodiment of the present invention, the cutting elements are formed of hard metal and interference fit into apertures in the cutters.

According to the preferred embodiment of the present invention, the cutting elements with crests oriented transversely to the axis of rotation of the cutter comprise 25 to 75% of the total number of cutting elements in the heel row of the cutter.

According to the preferred embodiment of the present invention, the remainder of the cutting elements in the heel row are chisel-shaped and have crests generally aligned with the axis of rotation of the cutter. The remainder of the cutting elements in the heel row can also be axisymmetric, ovoid or conical, in configuration.

DESCRIPTION OF THE PREFERRED EMBODIMENT

Figure 1:
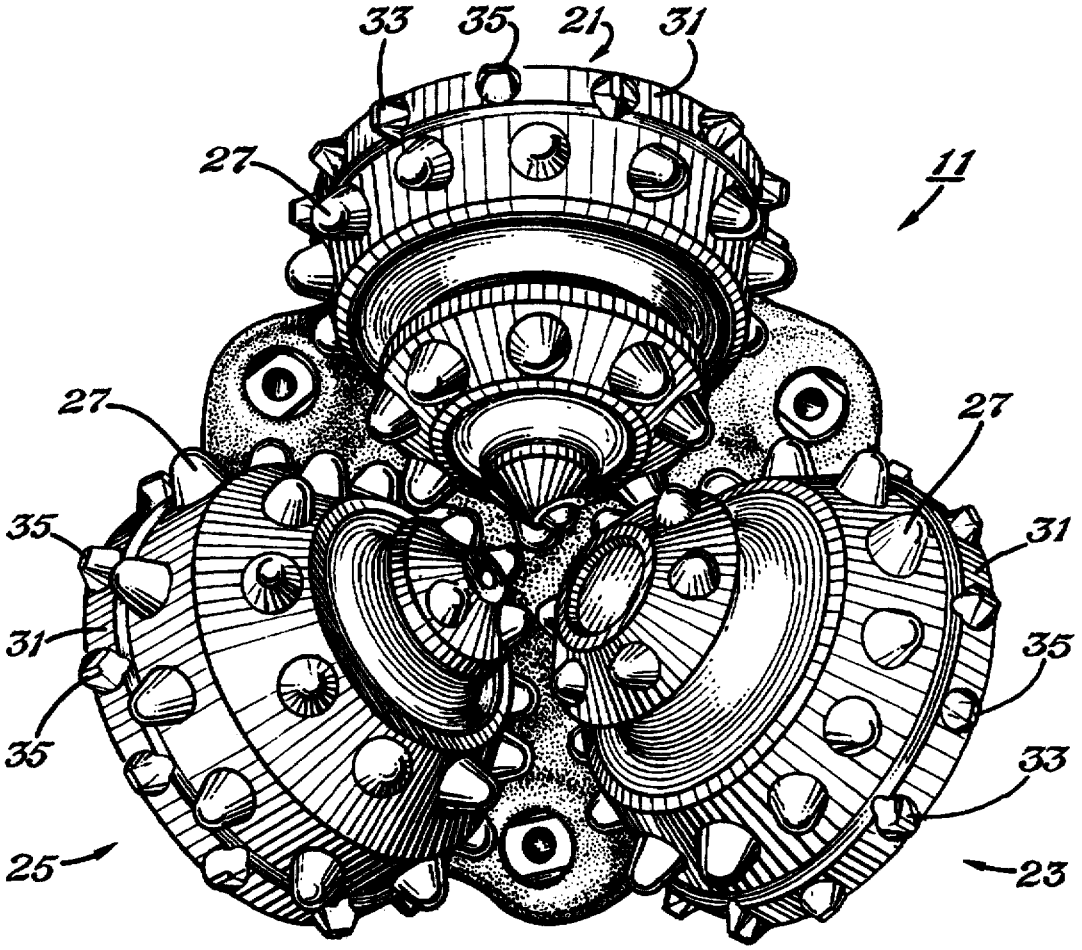
FIG. 1 is a plan view, looking upwardly at the cutting structure, of an earth-boring bit according to the present invention.

Referring now to the Figures, and particularly to FIG. 1, an earth-boring bit 11 according to the present invention is illustrated viewed looking upwardly at the cutting structure. Bit 11 includes a bit body 13, which is threaded at its upper extent (not shown) for connection into a drillstring. A plurality of nozzles 15 are carried by bit body 13 and discharge pressurized drilling fluid from the drillstring onto the bottom of the borehole to cool and lubricate bit 11 and to remove cuttings as formation material is disintegrated.

Three cutters 21, 23, 25 are mounted for rotation on cantilevered bearing shafts (obscured from view in FIG. 1) depending inwardly and downwardly from bit body 13. Each cutter 21, 23, 25 includes a plurality of cutting elements 27 arranged in generally circumferential rows on the frusto-conical cutters. According to the preferred embodiment of the present invention, cutting elements 27 are formed of hard metal, preferably cemented tungsten carbide, and are secured by interference fit in apertures in each cutter.

A heel surface 31 is defined on each cutter 21, 23, 25 just inward and adjacent an outermost or gage surface (41 in FIG. 2) adapted to engage the sidewall of the borehole in drilling operation.

A plurality of heel cutting elements 33, 35 are secured to heel surface 31 of each cutter 21, 23, 25 to define a heel row of elements. According to the preferred embodiment of the present invention, axial crested wedge-chisel cutting elements 33 alternate with circumferential crested chisel cutting elements 35. Axial cutting elements 33 are so named because their crests are aligned with the axis of rotation of each cutter. Circumferential cutting elements 35 are so named because their crests are oriented circumferentially or transversely to the axis of rotation of each cutter. According to the preferred embodiment of the present invention, the circumferential cutting elements 35 comprise 25 to 75% of the cutting elements in the heel row of cutting elements on a single cutter.

Figure 2:
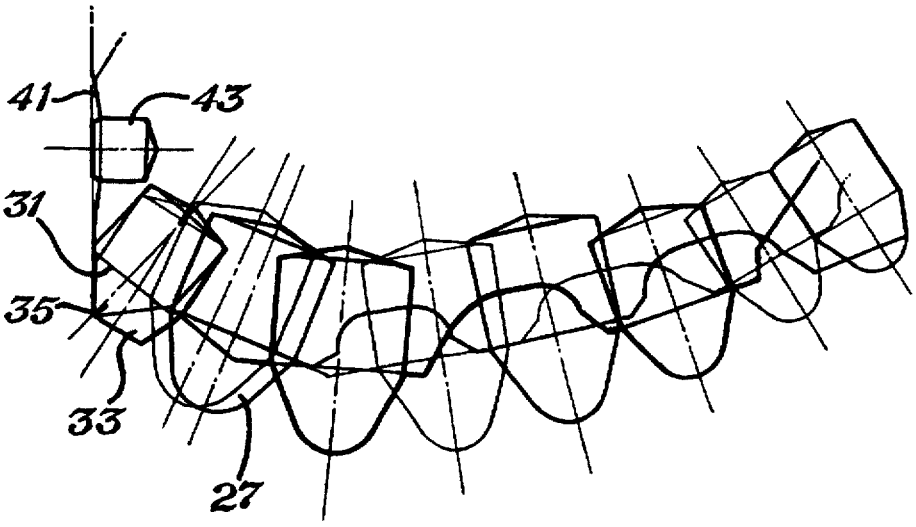
FIG. 2 is a fragmentary, enlarged section view of the earth-boring bit of FIG. 1, that schematically illustrates the cutting profile as defined by the interrelationship between the cutting element on the various cutters superimposed upon one another.

FIG. 2 is an enlarged, fragmentary section view schematically depicting the superimposition of the cutting elements 27, 33, 35 of each cutter 21, 23, 25 that illustrates the cutting structure defined by those elements relative to the bottom and sidewall of the borehole. Inner rows of conical cutting elements 27 extend generally from the center of the borehole to near the outermost periphery of the bit. At the outermost periphery of bit 11, heel cutting elements 33, 35 combine to kerf the outermost portion of the bottom of the borehole and the sidewall and corner of the borehole. Gage inserts 43 are secured to gage surface 41 to kerf the sidewall of the borehole in addition to the outer surfaces of heel cutting elements 33, 35.

Axial wedge-chisel cutting elements 33 cut the outermost corner of the borehole bottom effectively and with good overall durability if their outer surfaces are not frictionally engaged with and scraping the corner and sidewall of the borehole. Circumferential chisel heel elements 35, with their transverse crest orientation, are more effective than axial heel elements 33 at scraping and trimming the sidewall of the borehole. Additionally, circumferential cutting elements 35 more effectively break up the rock ribs that conventionally are left in the corner of the borehole between conventional axial wedge-crested heel elements 33. Both axial elements 33 and circumferential elements 35 have approximately the same projection from heel surface 31 of each cutter 21, 23, 25 to insure that both types of elements function as primary cutting structure. Approximately the same projection means that cutting elements 33, 35 vary in projection no more than about 25%, e.g. circumferential heel elements 35 can project about 25% less than axial heel elements 33 and vice-versa. It may also be advantageous to provide the scraper or trimmer inserts disclosed in commonly assigned U.S. Pat. No. 5,351,768 at the intersection of heel 31 and gage 41 surfaces to provide secondary cutting structure to assist in kerfing the sidewall and corner of the borehole.

Figure 3:
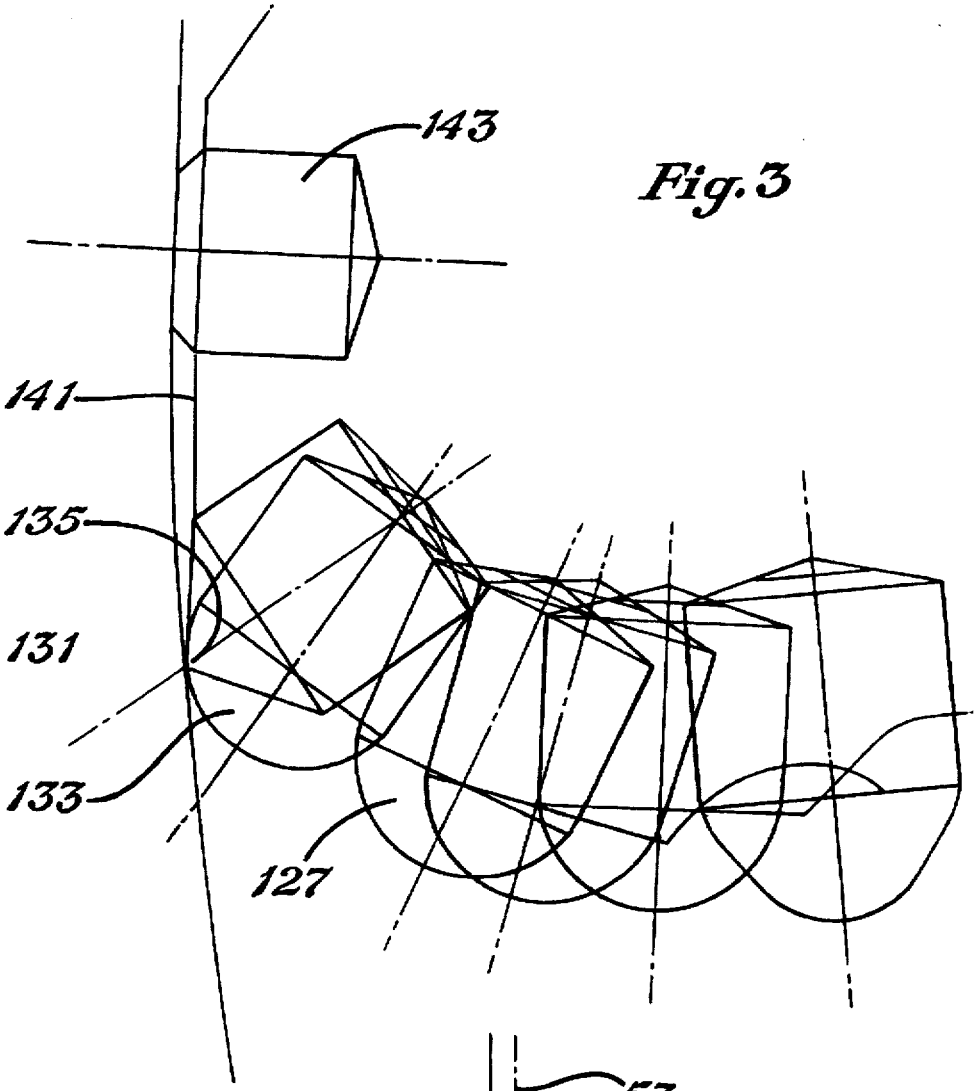
FIG. 3 is a fragmentary, enlarged section view, similar to that of FIG. 2, depicting another embodiment of the earth-boring bit according to the present invention.

FIG. 3 is a fragmentary, enlarged section view similar to FIG. 2, illustrating the cutting structure of an earth-boring bit according to the present invention that is adapted for drilling harder formations than that depicted in FIGS. 1 and 2. Inner row cutting elements 127 have lower projections than cutting elements for softer formation bits and are axisymmetric, ovoid or conical, to resist breakage when encountering hard formation materials. Similarly, heel cutting elements 133 are ovoid in configuration and project from heel surface 131 a relatively small amount. Circumferential heel cutting elements 135 are interspersed in the same heel row on the same cutter with ovoid heel elements 133 and serve essentially the same function as described in connection with FIG. 2. In this embodiment, circumferential heel elements 135 are placed on heel surface 131 to position their crests further up the sidewall of the borehole than the structure shown in FIG. 2. While axisymmetric heel elements 133 cut the outermost kerf on the bottom of the borehole, circumferential chisel cutting elements 135 scrape the sidewall and corner of the borehole and destroy nascent rock ribs forming there. Gage elements 143 on gage surface 141 assist heel cutting elements 133, 135 in scraping the sidewall of the borehole and maintaining gage.

Figure 4:
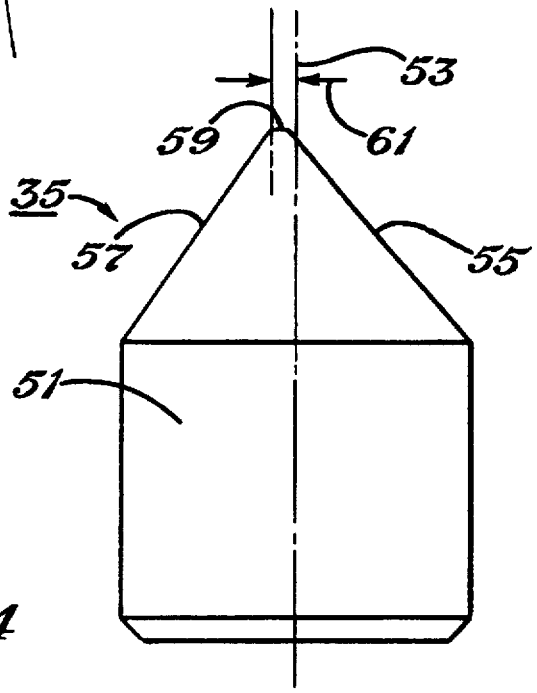
FIG. 4 is an elevation view of a cutting element employed in the cutting structure of the earth-boring bit according to the present invention.

FIG. 4 is an elevation view of a preferred form of circumferential chisel cutting element 35. Cutting element 35 is formed of hard metal, preferably cemented tungsten carbide, and includes a generally cylindrical body 51 having a central longitudinal axis 53. Body portion 51 of cutting element 35 is adapted to be secured by interference fit in a socket or aperture in the heel surfaces of the cutters. A pair of flanks 55, 57 extend from cylindrical body 51 to define a chisel crest 59. Chisel crest 59 is offset a selected distance 61 from the central longitudinal axis 53 of cylindrical body 51. The direction of offset 61 of crest 59 define which of flanks 55, 57 is the outermost flank of cutting element 35 when it is assembled into a cutter. For the direction of offset illustrated, flank 57 is the outer surface of cutting element 35.

According to the preferred embodiment of the present invention, a cutting element 35 for use in a 7⅞ inch, relatively soft formation bit (such as that depicted in FIG. 1) has a cylindrical body 51 0.438 inch diameter. Crest 59 is offset from central longitudinal axis of body 51 0.039 inch. Crest 59 extends beyond body 51 (and projects beyond heel surface 31) approximately 0.250 inch. Alternatively, crest 59 may be aligned with axis 53 of body, yielding no offset at all.

The invention has been described with reference to preferred embodiments thereof. It is thus not limited, but is susceptible to variation and modification without departing from the scope of the invention.

We claim:

1. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in circumferential rows on the cutter, the rows including a heel row;

the cutting elements in the heel row including at least one chisel-shaped cutting element having a crest oriented transversely to the axis of rotation of the cutter, the remainder of the cutting elements in the heel row having a configuration different from the chisel-shaped elements having crests oriented transversely to the axis of rotation of the cutter, all of the cutting elements in the heel row having approximately the same projection from the heel surface of the cutter.

2. The earth-boring bit according to claim 1 wherein the cutting elements are formed of hard metal and interference fit into apertures in the cutter.

3. The earth-boring bit according to claim 1 wherein the cutting elements with crests oriented transversely to the axis of rotation of the cutter comprise 25 to 75 percent of the total number of cutting elements in the heel row of the cutter.

4. The earth-boring bit according to claim 1 wherein the remainder of the cutting elements in the heel row are axisymmetric in configuration.

5. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in circumferential rows on the cutter, the rows including a heel row;

the cutting elements in the heel row including chisel-shaped elements having crests, the crests of a portion of the cutting elements being oriented transversely to the axis of rotation of the cutter, the remainder of the cutting elements in the heel row having crests generally aligned with the axis of rotation of the cutter, all of the cutting elements in the heel row having approximately the same projection from the heel surface of the cutter.

6. The earth-boring bit according to claim 5 wherein the cutting elements are formed of hard metal and interference fit into apertures in the cutter.

7. The earth-boring bit according to claim 5 wherein the circumferential cutting elements with crests oriented transversely to the axis of rotation of the cutter comprise 25 to 75 percent of the total number of cutting elements in the heel row.

8. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in circumferential rows on the cutter, the rows including a heel row on the heel surface of the cutter;

the crests of a portion of the cutting elements in the heel row being oriented transversely to the axis of rotation of the cutter, the remainder of the cutting elements in the heel row being axisymmetric in configuration, all of the cutting elements in the heel row having approximately the same projection from the heel surface of the cutter.

9. The earth-boring bit according to claim 8 wherein the cutting elements are formed of hard metal interference fit in apertures in the heel surface of the cutter.

10. The earth-boring bit according to claim 8 wherein 25 to 75 percent of the cutting elements in the heel row have crests oriented transversely to the axis of rotation of the cutter.

11. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in circumferential rows on the cutter;

the cutting elements in the at least one row including at least one chisel-shaped cutting element having a crest oriented transversely to the axis of rotation of the cutter, the remainder of the cutting elements in the at least one row having a configuration different from the chisel-shaped elements having crests oriented transversely to the axis of rotation of the cutter with no crest, all of the cutting elements in the row having approximately the same projection from the surface of the cutter.

12. The earth-boring bit according to claim 11 wherein the cutting elements are formed of hard metal and interference fit into apertures in the cutter.

13. The earth-boring bit according to claim 11 wherein the cutting elements with crests oriented transversely to the axis of rotation of the cutter comprise 25 to 75 percent of the total number of cutting elements in the row of the cutter.

14. The earth-boring bit according to claim 11 wherein the remainder of the cutting elements in the row are axisymmetric in configuration.

15. The earth-boring bit according to claim 11 wherein the row is a heel row on the cutter.

16. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in circumferential rows on the cutter;

the cutting elements in at least one row including chisel-shaped elements having crests, the crests of a portion of the cutting elements being oriented transversely to the axis of rotation of the cutter, the remainder of the cutting elements in the at least one row having crests generally aligned with the axis of rotation of the cutter, all of the cutting elements having approximately the same projection from the surface of the cutter.

17. The earth-boring bit according to claim 16 wherein the cutting elements are formed of hard metal and interference fit into apertures in the cutter.

18. The earth-boring bit according to claim 16 wherein the circumferential cutting elements with crests oriented transversely to the axis of rotation of the cutter comprise 25 to 75 percent of the total number of cutting elements in the heel row.

19. The earth-boring bit according to claim 16 wherein the row is a heel row on the cutter.

20. An earth-boring bit comprising:

a bit body;

at least one cantilevered bearing shaft depending inwardly and downwardly from the bit body;

a cutter mounted for rotation on the bearing shaft, the cutter including a plurality of cutting elements arranged in circumferential rows on the cutter;

the crests of a portion of the cutting elements in at least one row being oriented transversely to the axis of rotation of the cutter, the remainder of the cutting elements in the at least one row being axisymmetric in configuration, all of the cutting elements having approximately the same projection from the surface of the cutter.

21. The earth-boring bit according to claim 20 wherein the cutting elements are formed of hard metal interference fit in apertures in the heel surface of the cutter.

22. The earth-boring bit according to claim 20 wherein 25 to 75 percent of the cutting elements in the heel row have crests oriented transversely to the axis of rotation of the cutter.

23. The earth-boring bit according to claim 20 wherein the row is a heel row on the cutter.

* * * * *